US010905906B2

(12) United States Patent
Canet et al.

(10) Patent No.: US 10,905,906 B2
(45) Date of Patent: Feb. 2, 2021

(54) BREATHING MASK FOR AIRCRAFT AND METHOD FOR PUTTING A BREATHING MASK IN FOLDED POSITION FOR STORAGE IN A STORAGE UNIT

(71) Applicant: Zodiac Aerotechnics, Plaisir (FR)

(72) Inventors: Laura Canet, Issy-les-Moulineaux (FR); Didier Lamourette, Les Essarts-le-Roi (FR)

(73) Assignee: Zodiac Aerotechnics, Plaisir (FR)

( * ) Notice: Subject to any disclaimer, the term of this patent is extended or adjusted under 35 U.S.C. 154(b) by 264 days.

(21) Appl. No.: 16/159,855

(22) Filed: Oct. 15, 2018

(65) Prior Publication Data

US 2019/0111289 A1 Apr. 18, 2019

(30) Foreign Application Priority Data

Oct. 17, 2017 (FR) ..... 17 59748

(51) Int. Cl.

| | |
|---|---|
| ***A62B 25/00*** | (2006.01) |
| ***A62B 18/08*** | (2006.01) |
| ***A62B 18/02*** | (2006.01) |
| ***A62B 7/14*** | (2006.01) |

(52) U.S. Cl.

CPC ..... *A62B 25/005* (2013.01); *A62B 7/14* (2013.01); *A62B 18/02* (2013.01); *A62B 18/08* (2013.01); *A62B 18/084* (2013.01)

(58) Field of Classification Search

CPC ..... B64D 25/005; B64D 7/14; B64D 18/08; B64D 18/084; B64D 18/02; B64D 11/00; B64D 13/00; B64D 2231/025; B64D 25/00; B64D 18/00; B64D 11/0632

See application file for complete search history.

(56) References Cited

U.S. PATENT DOCUMENTS

| | | | | |
|---|---|---|---|---|
| 5,488,948 | A | 2/1996 | Dubruille et al. | |
| 2003/0000001 | A1 | 1/2003 | McDonald et al. | |
| 2014/0290665 | A1* | 10/2014 | Libis | A62B 18/084 128/206.27 |

FOREIGN PATENT DOCUMENTS

| | | |
|---|---|---|
| EP | 0645164 | 3/1995 |
| EP | 2060294 | 5/2009 |
| EP | 2773432 | 9/2014 |
| WO | 2015177584 | 11/2015 |

OTHER PUBLICATIONS

France Application No. 1759748, Search Report and Written Opinion dated Sep. 6, 2018, 9 pages.

* cited by examiner

*Primary Examiner* — Timothy A Stanis
*Assistant Examiner* — Arielle Wolff
(74) *Attorney, Agent, or Firm* — Kilpatrick Townsend & Stockton LLP

(57) ABSTRACT

Breathing mask comprising a shell and a harness, wherein:

the breathing mask also comprises a folding system adapted to make the harness move from an extended position to a folded position, the folding system also comprises a pulling device and a guide device, the pulling device has a connecting portion connected to the harness and a gripping portion, the guide device is connected to the shell, the pulling device is free to move between a first position and a second position, and the guide device cooperates with the pulling device to guide the pulling device between the extended position and the folded position.

15 Claims, 10 Drawing Sheets

BREATHING MASK FOR AIRCRAFT AND METHOD FOR PUTTING A BREATHING MASK IN FOLDED POSITION FOR STORAGE IN A STORAGE UNIT

CROSS REFERENCE TO RELATED APPLICATIONS

This application claims priority from France Patent Application No. 1759748 filed Oct. 17, 2017, the entire contents of which are incorporated herein by this reference.

FIELD OF THE INVENTION

The invention relates to a breathing mask for aircraft, designed to provide a breathing mask to a user, an assembly to supply breathing gas comprising a breathing mask and a method for putting a breathing mask into a folded position for storage in a storage unit.

BACKGROUND OF THE INVENTION

The invention aims to provide a solution for storage and for use of an assistance system composed of a breathing mask supplying a breathing gas to a user such as a crew member, for example in an emergency situation. This breathing gas is supplied through a breathing mask. The breathing mask comprises a shell with a breathing cavity, and is adapted to be applied to the face of the crew member, particularly around the mouth and the nose. The breathing mask also comprises a harness. This harness is adapted to extend around the user's head opposite the shell, so as to hold the shell on the user's face.

The breathing mask optionally comprises a protection screen. The protection screen protects the user's eyes against projections, and particularly fumes. In a folded position, the breathing mask is placed in a storage unit located in the cabin of an aircraft, generally a commercial aircraft transporting passengers and a crew. The aircraft also generally comprises a pressurisation device that pressurises the cabin so as to enable passengers and crew members to breath normally in the cabin.

If necessary (particularly in case of depressurisation, preventive wearing or in the case of noxious gas or smoke), the user of the emergency equipment that is normally the pilot or the copilot, picks up the breathing mask that is located in the storage unit. The user then places the breathing mask around his or her head so that he or she can breathe through the breathing mask, thus supplying breathing gas.

The storage unit is thus important to protect the breathing mask when it is not used.

Moreover, in an emergency situation, the breathing mask must be put into position quickly (in less than 5 seconds) and reliably on the crew member's head, for regulatory and safety reasons. It is also necessary that the breathing mask can be manipulated with one hand, so that the crew member can continue his or her tasks using the other free hand.

In order to respect these prerequisites, a frequently used breathing mask harness is an inflatable harness. The harness thus becomes longer as gas is introduced under pressure inside the harness, so that the pilot's head can pass through the harness and the breathing mask can be positioned on the user's head. Introduction of gas under pressure into the harness is controlled by a valve. Once the breathing mask has been appropriately positioned, the gas under pressure is released which causes contraction of the harness around the user's head so that the shell can be correctly applied on the user's face. Furthermore, with the objective of speed of installation and placement of the breathing mask on the user's head, it is also important to avoid any obstacle that could slow inflation of the harness. To achieve this, document EP 2773432B1 discloses a method of storing a breathing mask in a storage unit. This method consists of preventing any fold or knot that might occur along the harness when the breathing mask is stored in the storage unit. Thus, the harness comprises a strap that has to be pulled to tighten it during the storage manipulation in the storage unit. However, this solution is not perfectly satisfactory. Once the breathing mask has been stored in the storage unit, it is impossible to verify that the breathing mask has been properly put away.

OBJECT AND SUMMARY OF THE INVENTION

To achieve this, according to the invention, the breathing mask has the following characteristics:

- the breathing mask also comprises a folding system adapted to make the harness move from an extended position to a folded position,
- the folding system also comprises a pulling device and a guide device,
- the pulling device has a connecting portion connected to the harness and a gripping portion,
- the guide device is connected to the shell,
- the pulling device is free to move between:
  - a first position in which the pulling device allows the harness to be in the extended position, and
  - a second position in which the pulling device holds the harness in the folded position, and
- the guide device cooperates with the pulling device to guide the pulling device between the extended position and the folded position.

The folding system contributes to obtaining practically the same folded position of the harness, which reduces the risk that the harness fails to extend satisfactorily during inflation. Therefore the folding system is a reliable tool that helps to put the breathing mask away in the appropriate position. The right folded position is particularly important in that it enables the breathing mask to extend in the right position and therefore the breathing mask can be put into place on the user's head quickly.

According to another characteristic conforming with the invention, the breathing mask preferably also comprises a protection screen adapted to protect the user's eyes, and the guide device is fixed to the shell above the protection screen, along a vertical axis.

Thus, the folding system does not interfere with the head of the crew member when the breathing mask is in use.

According to a complementary characteristic according to the invention, when the harness is in the extended position, the gripping portion is placed above the protection screen, in a projection along a direction perpendicular to the plane of the protection screen.

Thus, the gripping portion does not interfere with the user's field of vision.

According to another characteristic conforming with the invention, the pulling device is preferably mounted free to move (only) in translation relative to the guide device, between the first position and the second position.

Thus, use of the folding system is intuitive, and consequently the risk of improper use is reduced.

According to another characteristic conforming with the invention, the pulling device preferably comprises a first connecting portion connected to the harness and a second connecting portion connected to the harness, when the pulling device is in the first position the first connecting portion is at a distance (along a transverse axis) from the second connecting portion by a first distance, the guide device also comprises a first guide element and a second guide element, the first guide element is separated from the second guide element by a second distance, and the first distance is at least 3 centimetres larger than the second distance.

Thus, when the harness is in the folded position, not only are the dimensions reduced along the direction of the horizontal axis along which it is pulled on the pulling device, but also along the direction of the transverse axis because the first connecting portion and the second connecting portion are brought towards each other when the pulling device moves from the first position to the second position.

According to another characteristic conforming with the invention, the pulling device preferably comprises a band of elastically flexible material to support the harness when the breathing mask is in the extended position.

Thus, the band of elastically flexible material acts against gravity to support the harness, which makes it easier to put it into place on the user's face.

In various embodiments of the breathing mask according to the invention, either or both of the following measures may also be adopted:

- the harness comprises an upper portion and a lower portion, the connecting portion of the pulling device being fixed to the upper portion of the harness;
- the pulling device comprises a tie, the tie terminating firstly at the connecting portion and secondly at the gripping portion;
- the tie slides in the guide device, to modulate the breathing mask between the extended position and the folded position;
- when the harness is in the extended position, the length between the connecting portion and the guide device is more than the length between the guide device and the gripping portion;
- when the harness is in the folded position, the length between the connecting portion and the guide device is less than the length between the guide device and the gripping portion;
- the breathing mask comprises a rigid support to which the shell is connected, the rigid support comprises a reception zone in which the gripping portion of the pulling device can fit, and when the pulling device is in the second position, the gripping element is located in the reception zone of the rigid support.

The invention also relates to an assembly that, in addition to the breathing mask, comprises a storage unit inside which the breathing mask will fit, the storage unit comprising a housing and an access opening through which the breathing mask is inserted into the housing, wherein in a stored position of the assembly in which the breathing mask is in the folded position, the gripping portion is located close to the access opening.

Thus, when the breathing mask is in the stored position, the user can check that the gripping portion is correctly positioned and consequently that the harness was placed in the satisfactory folded position.

According to another characteristic conforming with the invention, the breathing mask preferably comprises a rigid support to which the shell is connected and having a reception zone, and the gripping portion is held in place between the housing and the reception zone of the rigid support when the assembly is in the stored position.

According to yet another characteristic conforming with the invention, the housing preferably comprises a cavity and the shape of the cavity is complementary to the shape of the gripping portion, the gripping portion is held in said cavity when the assembly is in the stored position.

Finally, the invention relates to a method of folding a breathing mask to store it in a storage unit, the breathing mask comprising a shell, a harness, a folding system, the shell having a breathing cavity and being adapted to be applied onto the face of a user, the folding system comprising a pulling device and a guide device cooperating with the pulling device, the pulling device comprising a gripping portion, in which process in a step a) the pulling device is pulled through the guide device by gripping the gripping portion to pull the breathing mask from an initial extended position to a final folded position.

According to another characteristic conforming with the invention, the breathing mask preferably also comprises a rigid support, the pulling device comprises a tie, the tie has a connecting portion and a gripping portion, the connecting portion being fixed onto the harness, and:

- during a step b) subsequent to step a), the gripping portion is brought back to the rigid support,
- during a step c), the breathing mask is inserted in the storage unit, and
- during a step d), the connecting portion is placed close to the access opening such that it is visible when the breathing mask is in the stored position.

During step a), the connecting portion stops in contact with the guide device.

DETAILED DESCRIPTION OF THE INVENTION

Figure 1:
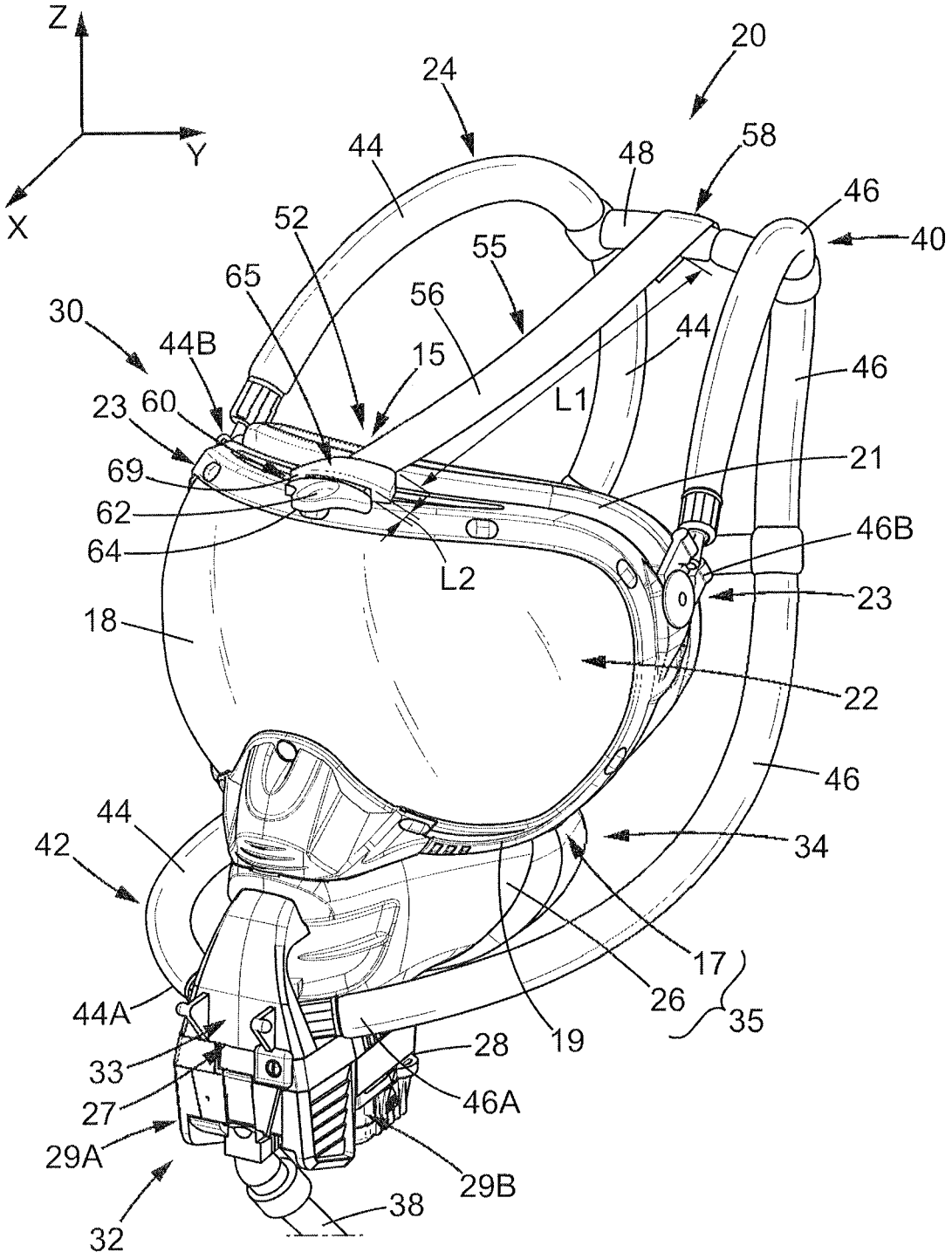
FIG. 1 is a perspective view of a breathing mask according to a first embodiment according to the invention, the breathing mask comprising a harness in the extended and deflated position.

Throughout the remainder of the description, identical elements or elements performing an identical function have the same reference sign. For reasons of conciseness of the description, these elements are not described for each embodiment, only the differences between the different embodiments being described in detail.

FIGS. 1 to 4 illustrate a breathing mask 20. The breathing mask 20 comprises particularly a shell 35, a harness 24 and a rigid support 28. Along a vertical Z axis, corresponding to the longitudinal axis of the human body when the breathing mask 20 is worn on a user's head, the breathing mask 20 comprises an upper part 30 and a lower part 32. The breathing mask 20 has a plane of symmetry extending perpendicular to a transverse Y axis.

In the embodiments illustrated, the breathing mask 20 comprises an oronasal part 26 and a protection screen 22, the protective protection screen 22 being fixed removably to the oronasal part 26. As a variant, the oronasal part 26 and the protection screen 22 could form an indissociable assembly.

Figure 6:
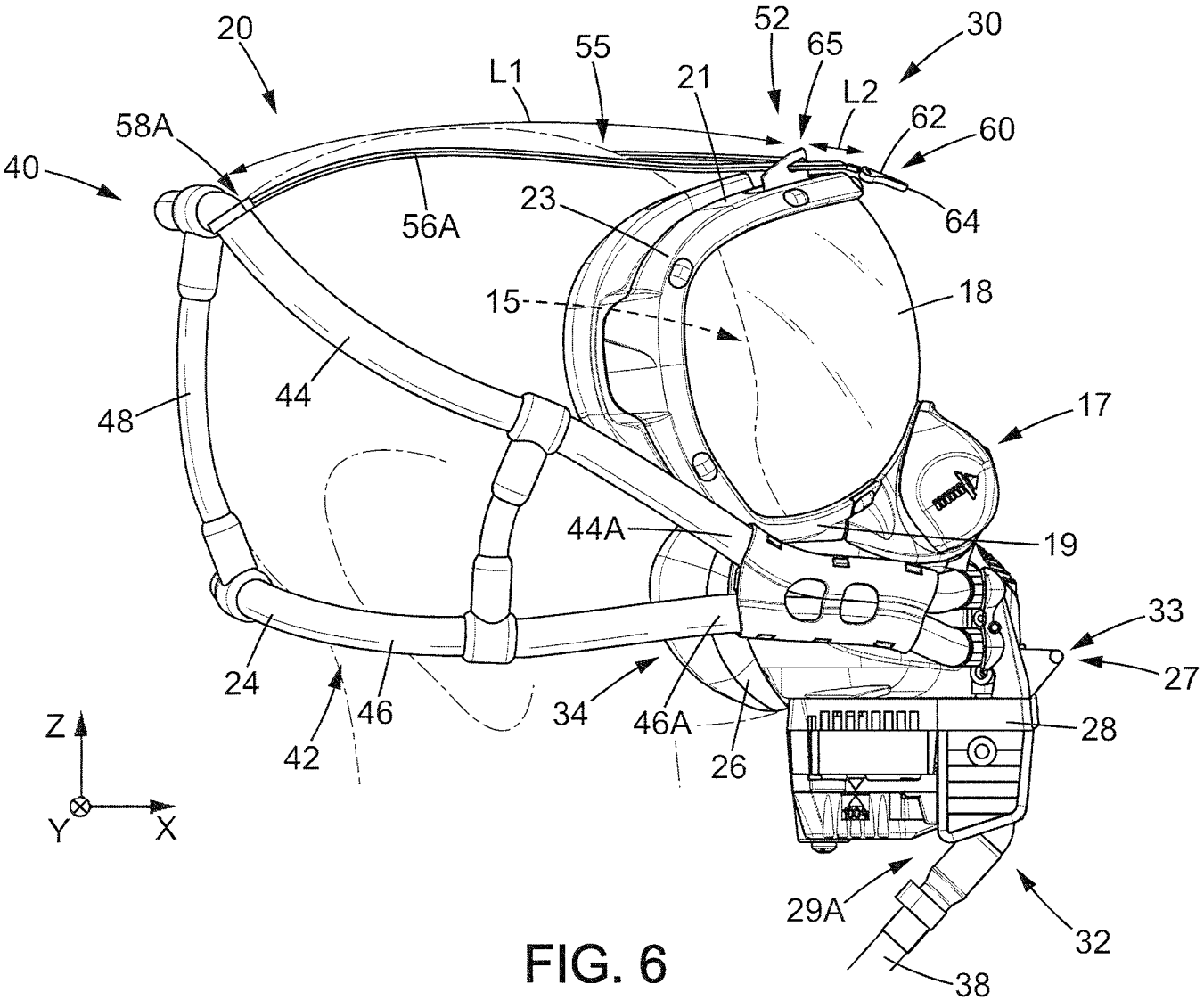
FIG. 6 is a side view of the breathing mask according to the second embodiment, the harness being in the extended and deflated position.
Figure 7:
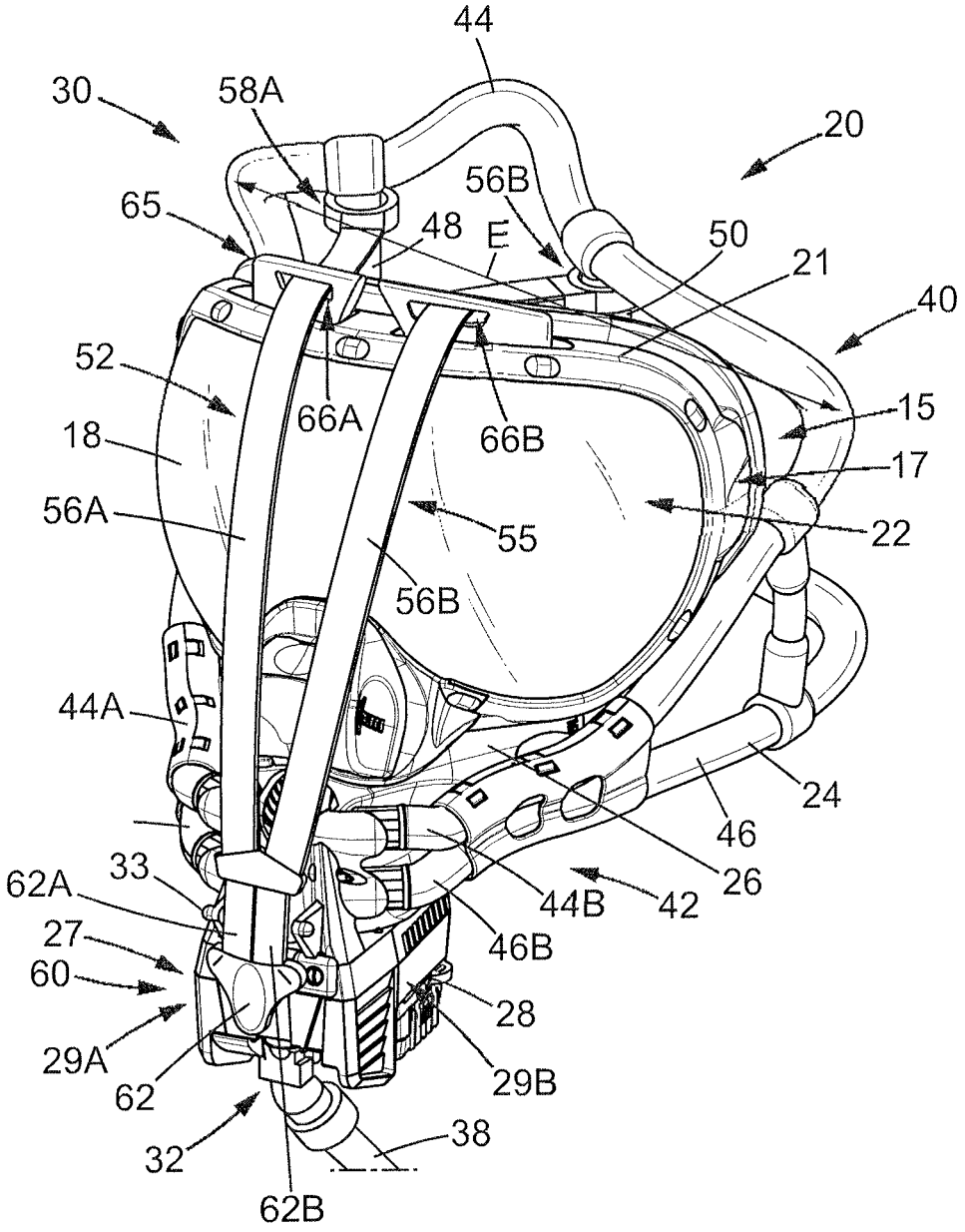
FIG. 7 is a perspective view of the breathing mask according to the second embodiment, the harness being in the folded position.
Figure 8:
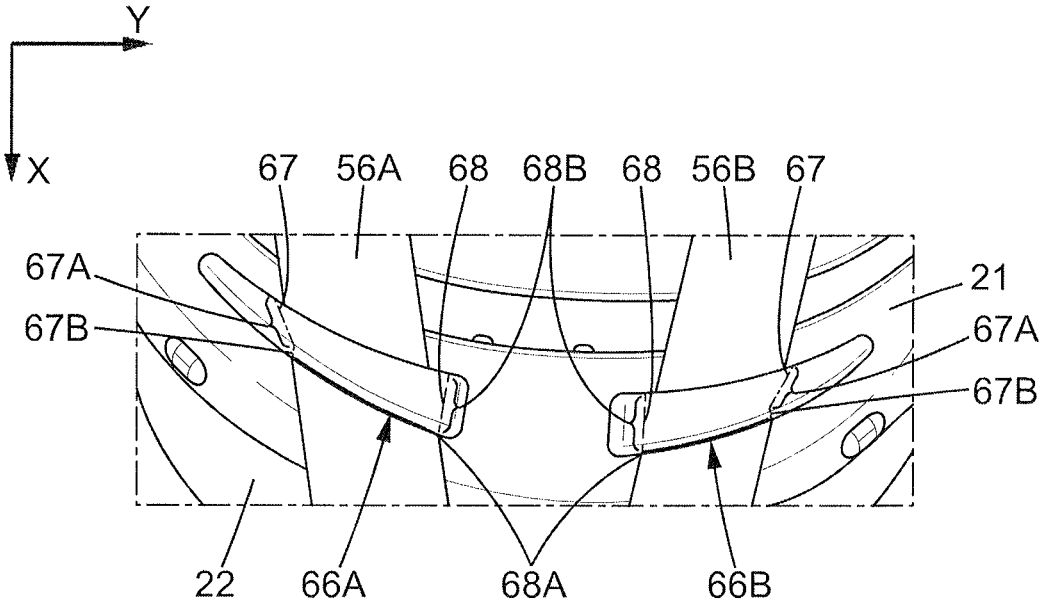
FIG. 8 is a partial top view of the second embodiment.

The oronasal part 26 has a breathing cavity 34. The breathing cavity 34 is adapted to be applied to the face of the user. More precisely, as can be seen on FIG. 6, the breathing cavity 34 is applied around the user's mouth and nose.

The protection screen 22 comprises a transparent lens 18 and a peripheral support 17. The transparent lens 18 is slightly convex and extends approximately perpendicular to a horizontal X axis, perpendicular to the vertical Z axis and to the transverse Y axis. The horizontal X axis corresponds to the anteroposterior axis of the human body when the breathing mask 20 is worn on a user's head, in other words the direction of the horizontal X axis lies approximately along the viewing direction of the user. The protection screen 22 is located in the top part 30 of the breathing mask 20. It protects the user's eyes, for example in case of smoke. The protection screen 22 comprises a front face 36 and a back face (not shown on the figures). The front face 36 will be in contact with the external environment. The back face will be in front of a user's face. The peripheral support 17 comprises particularly two lateral parts 23, an upper edge 21 and a lower edge 19. Each lateral part 23 receives a second end of the loops 44B, 46B of the harness 24. The lower edge 19 is in contact with the oronasal part 26 or at least facing and close to the oronasal part 26. The protection screen 22 also comprises a cavity 15 in which there is an opening on the back face of the breathing mask 20.

The shell 35 comprises the oronasal part 26 and the peripheral support 17 of the protection screen 22. In the variant wherein the oronasal part 26 and the eye protection screen 22 form an indissociable assembly, the cavity 15 of the protection screen 22 and the cavity 34 of the oronasal part 26 are continuously in communication with each other and in particular there might not be any separation between the cavity 15 of the protection screen 22 and the cavity 13 of the oronasal part, such that they form a single cavity.

In the embodiments illustrated, the harness 24 is an inflatable harness. The harness 24 can be configured between an inflated position illustrated in FIG. 5, and a deflated position illustrated for example in FIGS. 1, 3 and 6. When a user is wearing the breathing mask 20, the harness fits around his or her head.

Along the vertical Z axis, the harness 24 comprises an upper portion 40 and a lower portion 42. The harness also comprises two loops 44, 46. Each loop is arranged on each side of the breathing mask 20, laterally. The two loops 44, 46 are connected to each other through spacer elements 48, 50. In the embodiment illustrated in FIGS. 1 to 4, the harness 24 comprises two spacer elements. The first spacer element 48 is placed in the upper portion 40 of the harness 24. The second spacer element 50 is placed in the upper portion of the harness 24. On FIG. 1, relative to the vertical Z axis, the first and second spacer elements 48, 50 are oriented to be perpendicular to the vertical Z axis.

The rigid support 28 is located in the lower part 32. More precisely, in the first embodiment illustrated in FIGS. 1 and 3 and in the second embodiment illustrated in FIGS. 5 to 9, the rigid support 28 is located approximately underneath the oronasal part 26 along the vertical axis, while in the variant of the first embodiment illustrated in FIGS. 2 and 4, the rigid support 28 is located approximately in front of the oronasal part 26. The rigid support 28 encloses a regulator to deliver breathing gas to the user on request. Furthermore, the rigid support encloses a harness inflation valve through which gas is introduced under pressure (breathing gas in the embodiments illustrated) into the harness to inflate it. The regulator and (in the embodiments illustrated) the inflation valve are supplied with breathing gas through a supply pipe 38 connected to the rigid support 28. Furthermore, the rigid support 28 comprises two lateral parts 29A, 29B, particularly intended for gripping the breathing mask 20 by pinching the rigid support 28 between the lateral parts 29A, 29B. Each lateral part 29A, 29B receives a first end of the loops 44A, 46A of the harness 24. The rigid support 28 also comprises a reception zone 27 and a retaining device, visible for example on FIGS. 1 and 3.

Furthermore, as illustrated on FIGS. 1 to 4, the breathing mask 20 comprises a folding system 52. This folding system 52 is adapted so that the harness can move from an extended position illustrated in FIG. 1, to a folded position illustrated in FIG. 3. The folding system also comprises in particular a pulling device 55 and a guide device 65. The pulling device 55 is free to move relative to the guide device 65 between a first position illustrated on FIGS. 1 and 2 and a second position illustrated on FIGS. 3 and 4.

The pulling device 55 comprises a tie 56. The tie 56 comprises a connecting portion 58 and a gripping portion 60. The tie 56 extends between the connecting portion 58 and the gripping portion 60 approximately along the horizontal X axis.

The connecting portion 58 is connected to the harness 24. According to the example illustrated on FIGS. 1 to 4, the connecting portion 55 is arranged on the first spacer element 48 of the harness 24. As a variant, the connecting portion 58 could be placed on a loop 44 or 46 of the harness 24. In the embodiments illustrated, the gripping portion 60 comprises a gripping element 62 distinct from the tie 56. However, the gripping element 62 could be integrated into the tie 56. The gripping element 62 is used to grip the pulling device 55 to put the breathing mask 20 into its folded position, when the harness is deflated. The shape of the gripping element 62 is approximately flat. For example, the thickness of the gripping element 62 is between 1 mm and 2.5 mm. The thickness of the gripping element is advantageously 1.5 mm within plus or minus 25%. Furthermore, the gripping element 62 comprises a stop surface 63 and a free edge 64. This edge 64 acts as a folding indicator. As can be seen on FIG. 10, the edge 64 provides a means of making a visual check that the breathing mask 20 is properly stored in a storage unit 54. For example, the edge 64 may be a strip with a colour different from the colour of the storage unit 54, so that it can easily be identified. For example, the colour of the edge 64 may be red, while the colour of the storage unit 54 is brown.

In the embodiments illustrated in FIGS. 1 to 4, the tie 56 is in the form of a strap. In this description, strap refers to a flat strip made of material with approximately constant thickness. According to another example embodiment, the tie may be any other means of performing a pulling action. For example, it may be a piece of string, a thread, a chain or a cable.

Figure 2:
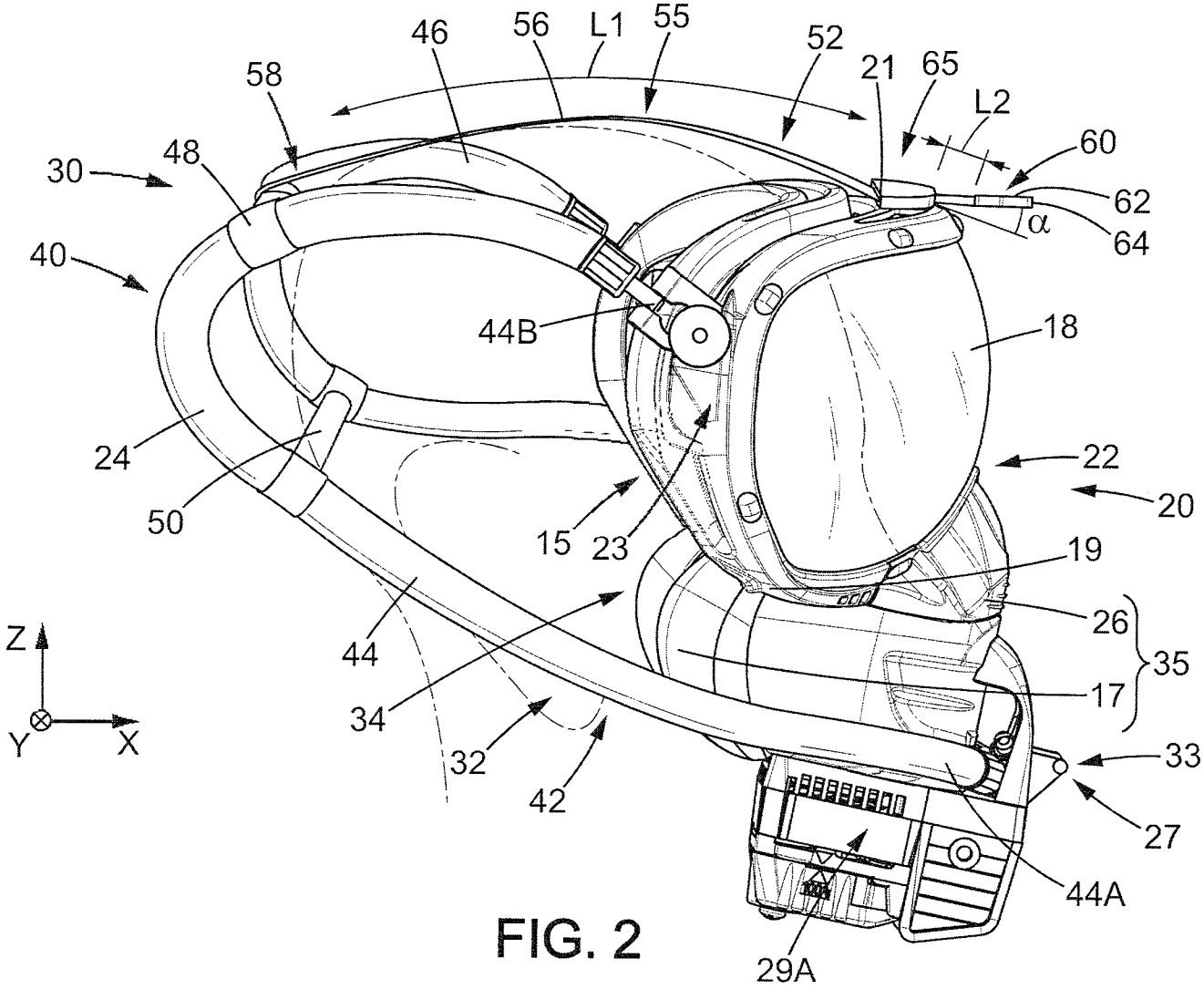
FIG. 2 is a side view of the breathing mask according to a variant of the first embodiment, the harness being in the extended and deflated position.
Figure 3:
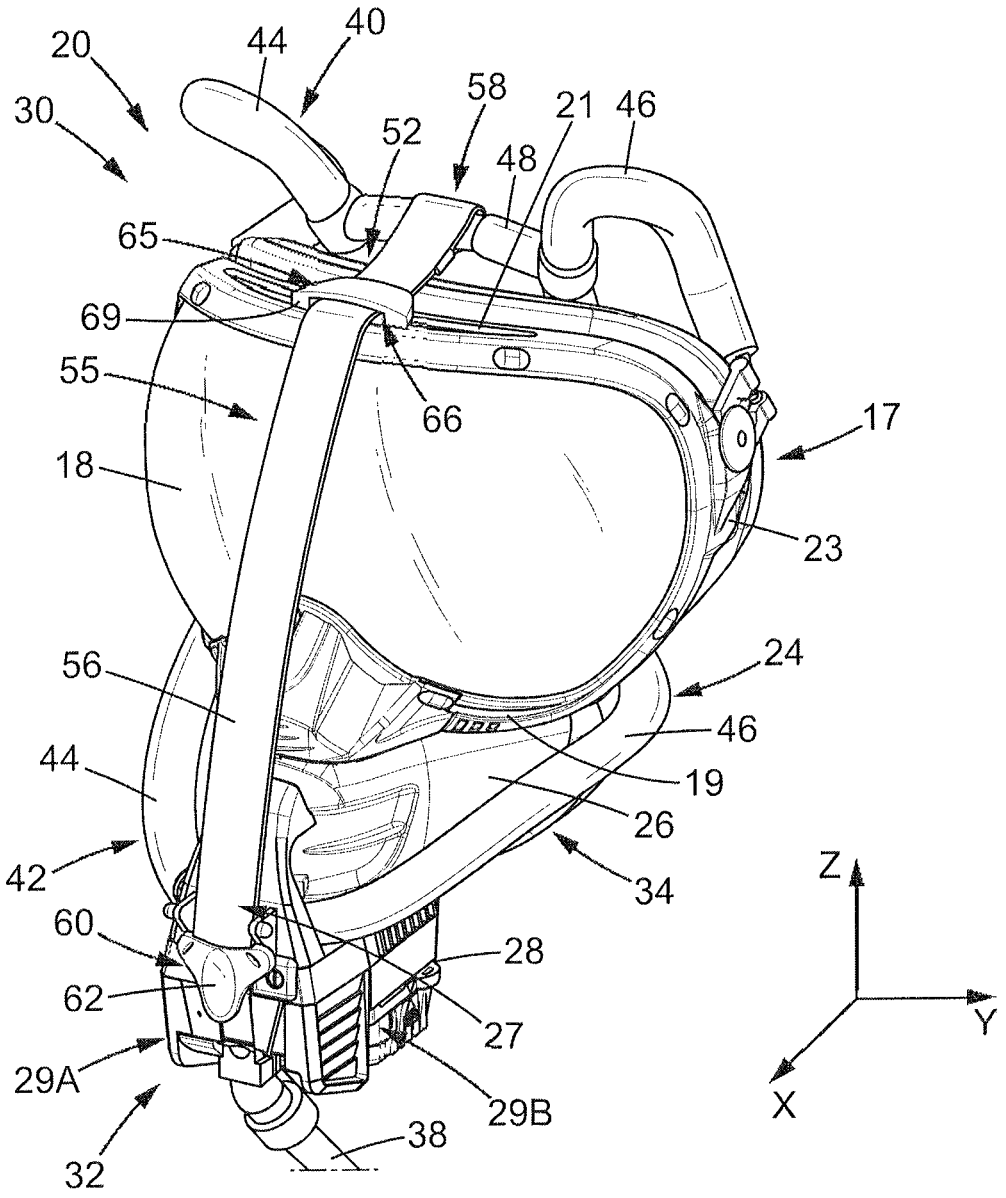
FIG. 3 is a perspective view of the breathing mask according to the first embodiment, the harness being in the folded position.

Secondly, in the first embodiment illustrated in FIGS. 1 and 3, the tie 56 is flexible and only has a low bending strength about the Y transverse axis. On the other hand, according to the embodiment illustrated in FIGS. 2 and 4, the tie 56 is elastically flexible and semi-rigid. For example, the tie 56 comprises a material with a low content of fibres, with the advantage of not being fragile and having a low coefficient of friction. For example, the tie comprises polypropylene (PP), acrylonitrile butadiene styrene (ABS), polycarbonate (PC), polyetherimide (PEI) or similar materials. Since the material of the tie 56 is elastically flexible, the tie 56 makes it possible to oppose the fact that the inflatable harness does not drop under its own weight, under the action of gravity. In other words, when the harness 24 is in an extended position, for example visible in FIG. 2, the tie 56 acts against the action of gravity on the harness 24. When the breathing mask is held in place by the rigid portion 28, the tie 56 holds the harness 24 in the extended position, approximately corresponding to the configuration of the breathing mask 20 when the mask is worn by a user. The tie 56 thus facilitates placement of the breathing mask on the user's head. In all cases, the material used for the tie 56 must be comfortable for the user when wearing the breathing mask 20 and provide some adaptability to the morphology of the user's head.

The guide device 65 is placed on the protection screen 26. More precisely, the guide device 65 is located opposite the rigid support 28 along the vertical Z axis. The guide device 65 is actually laid out on the upper border 21 of the protection screen 22. The guide device 65 comprises a passage 66. This passage 66 is sized so that the tie 56 can pass through it. According to the example illustrated in FIGS. 1 to 4, the passage 66 is a slit. The shape of this slit is such that a strap can pass through it. The slit is slightly wider than the strap so that the strap can slide inside the guide device 65 approximately along the horizontal X axis without any other movement between the tie 56 and the guide device. In particular, in the variant of the first embodiment illustrated in FIGS. 1 and 3, the tie 56 may be (practically) unable to pivot around the transverse Y axis relative to the guide device 65. In the first embodiment, the slit has a constant width over its entire length, in other words the slit is in the shape of a rectangular parallelepiped, which only allows forward and return movement of the strap. Therefore the shape of the slit determines the sliding movement of the strap in the guide device 65. The passage 66 may include two (or more) segments slightly separated from each other along the horizontal X axis.

Other shapes can be made depending on the shape of the tie. For example, the passage 66 can be a gutter. According to another example, the passage 66 has a circular section.

The folding system is also adapted to prevent the gripping portion 62 from entering the user's field of vision when the harness 24 is in the extended position. The gripping portion 62 extends upwards (moving away from the transparent lens 18 projected along the vertical axis) and forwards (moving away from the guide device 65 projected along the horizontal axis 65).

To achieve this, in the case of the first embodiment illustrated in FIGS. 1 and 3, it is possible to make the passage terminate with a slight inclination forwards and upwards in an elevation view as illustrated in FIG. 2, which makes the gripping portion move upwards and therefore away from the field of vision. It would also be possible to provide an appropriate inclination or a rim on the stop surface 63 or on a thrust surface 69 of the guide device 65, the stop surface 63 of the pulling device 55 coming into contact with the thrust surface 69 when the pulling device is in the first position. In the case of the variant of the first embodiment illustrated in FIGS. 2 and 4, the pulling device 55 and the gripping portion 60 form an angle $\alpha$ at (close to) the gripping portion 60.

The extended and folded positions of the harness 24 will now be described with reference to FIGS. 1 to 4.

When the harness 24 is in the extended position as shown on FIGS. 1 and 2, the pulling device 65 is in the first position, the length L1 of the tie 56 that is between the connecting portion 58 and the guide device 65 is more than the length L2 of the tie 56 that is located between the guide device 65 and the gripping portion 60. In other words, the connecting portion 58 is kept at a distance from the protection screen 22. In particular, preferably the stop surface 63 of the gripping portion 60 is in contact with the thrust surface 69 of the guide device 65, such that the length L2 is zero. Furthermore, the gripping portion 60 is arranged on the top part 30 of the breathing mask 20. More precisely, considering the vertical Z axis, in this case passing through the guide device 55, the horizontal projection along the horizontal X axis of the gripping portion 62 on the vertical Z axis is above the transparent lens 18.

Figure 4:
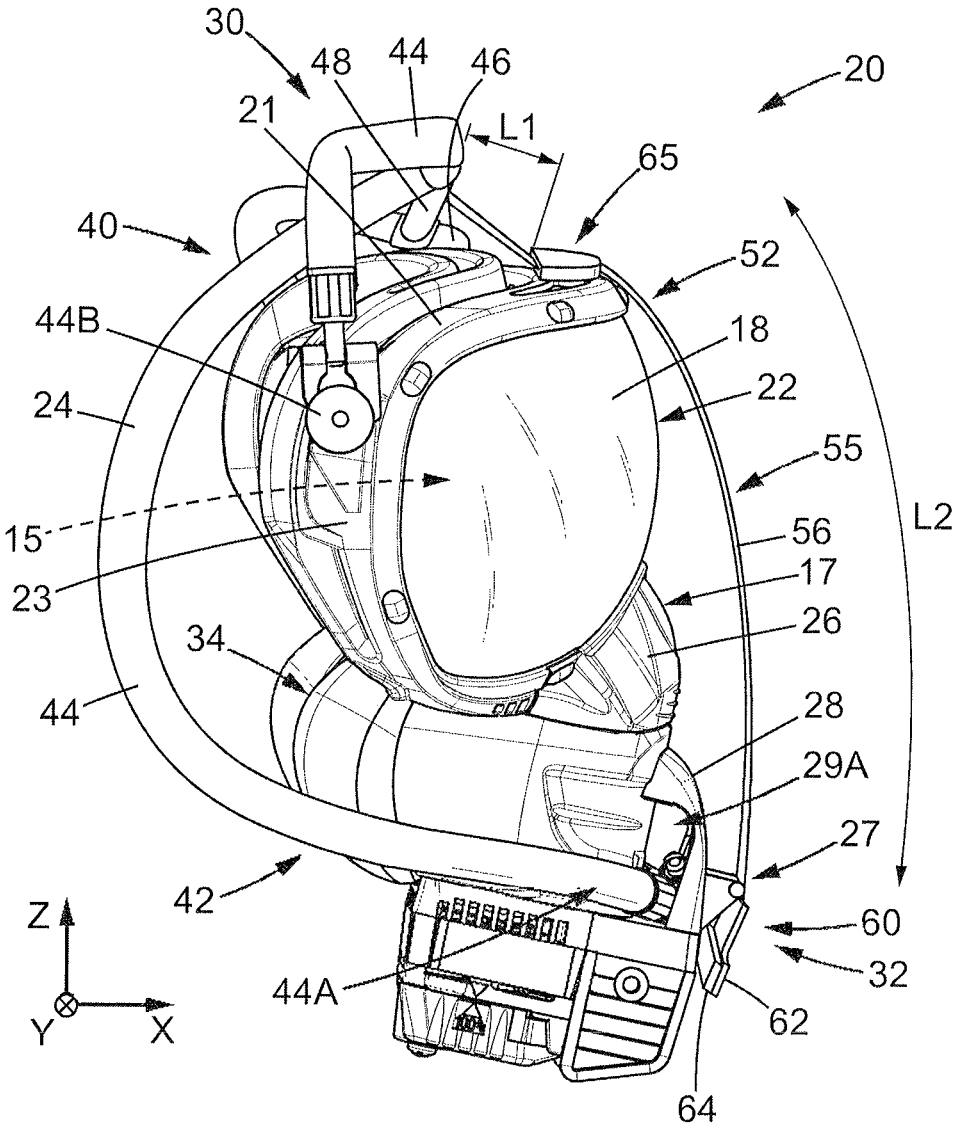
FIG. 4 is a side view of a breathing mask according to a variant of the first embodiment, the harness being in the folded position.

By bringing the pulling device into the second position when the harness 24 is deflated, the harness 24 is brought into the folded position as can be seen on FIGS. 3 and 4. When the harness is in the folded position, the length L1 of the tie 56 that is between the connecting portion 58 and the guide device 65 is less than the length L2 of the tie 56 that is located between the guide device 65 and the gripping portion 60. In other words, the connecting portion 58 is close to the protection screen 22. Furthermore, the gripping portion 60 is located in the reception zone 27 of the rigid support 28. Preferably, the stop surface 63 bears against the retaining device 33.

Figure 10:
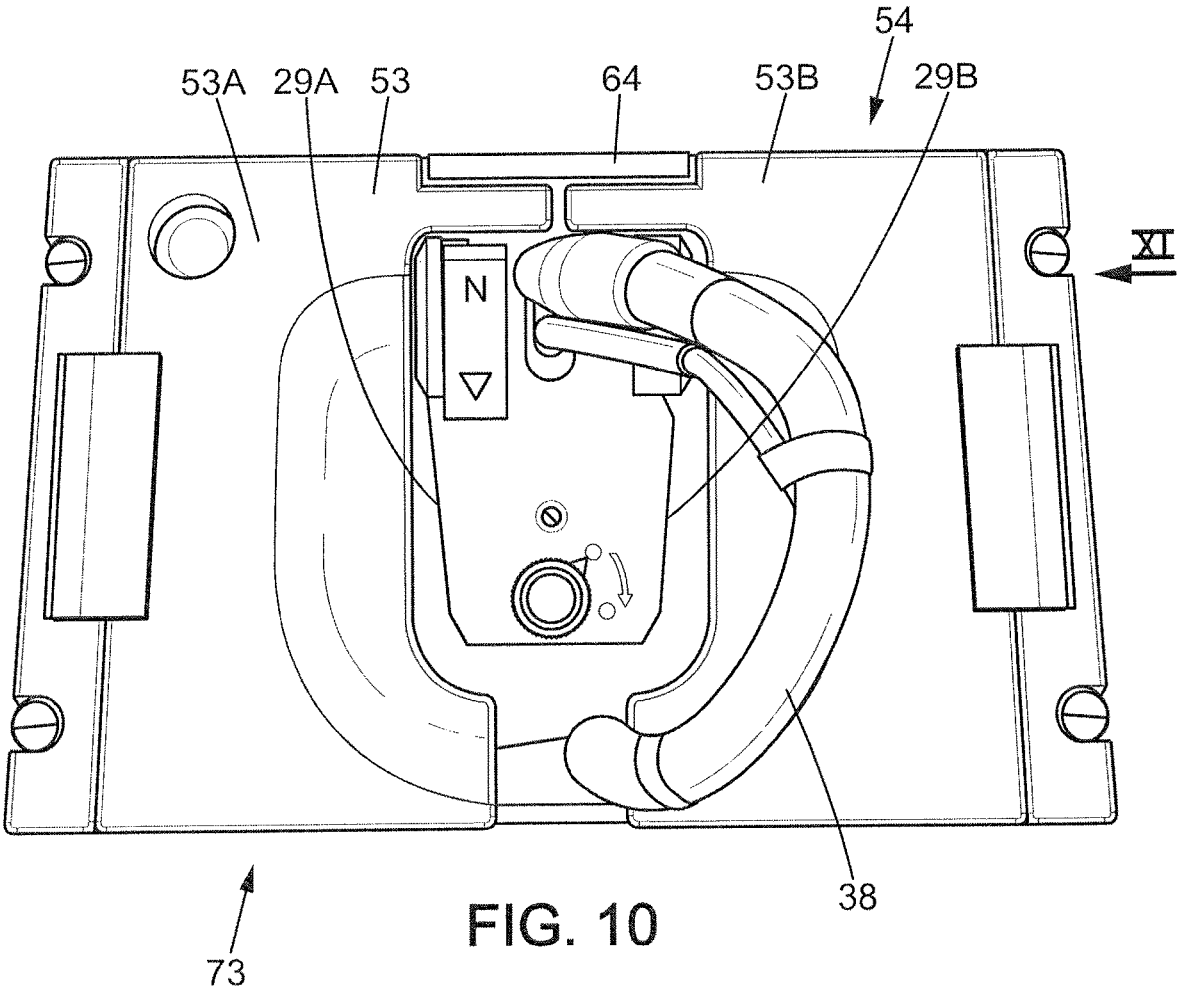
FIG. 10 illustrates an assembly comprising a breathing mask and a storage device according to one embodiment conforming with the invention, the breathing mask being in the stored position inside the storage unit.
Figure 11:
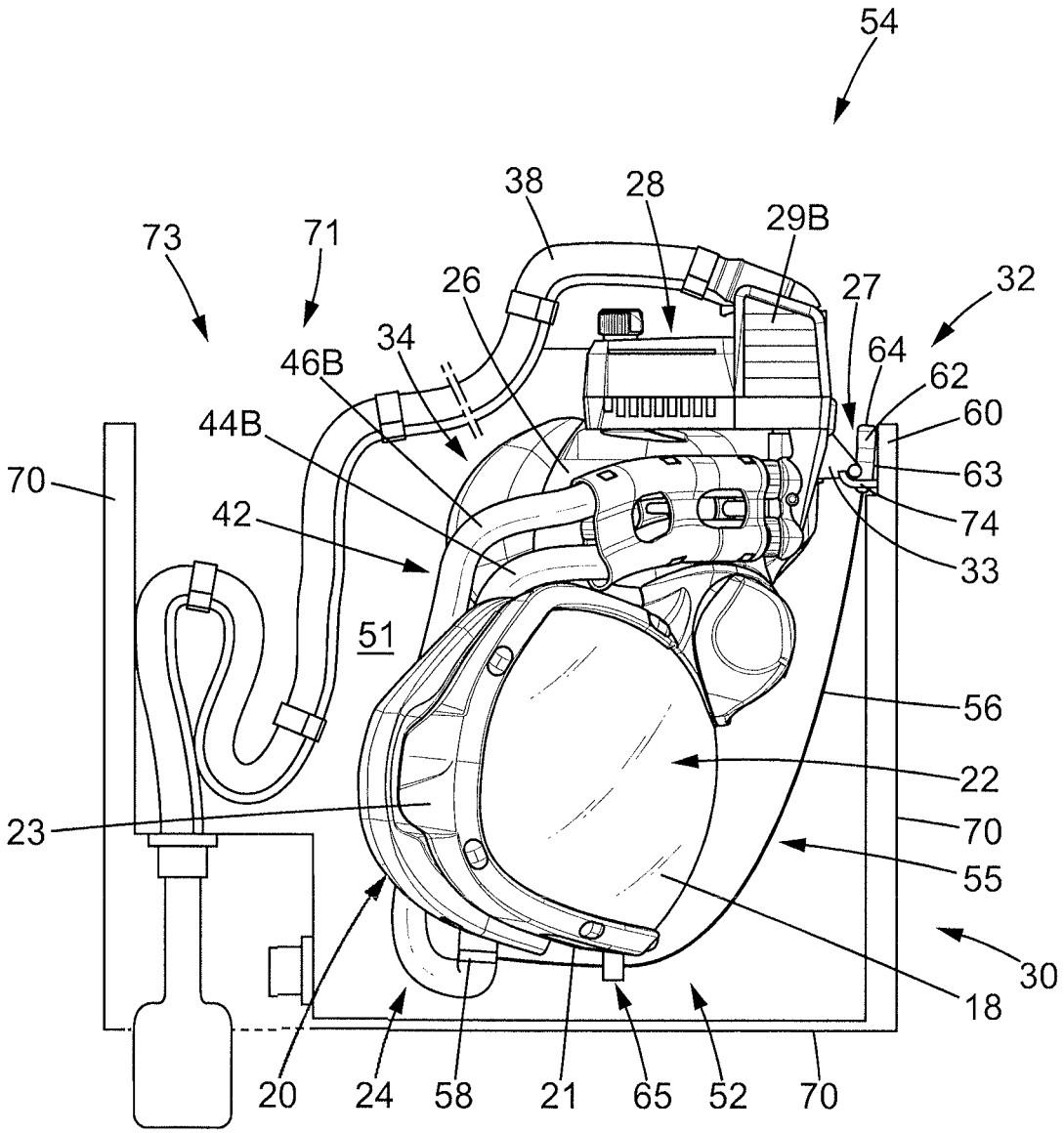
FIG. 11 shows a representation of the assembly in FIG. 10 along the arrow mark XI in FIG. 10.

When the harness 24 is in the folded position, it can be stored in the storage unit 54 as illustrated in FIGS. 10 and 11. The storage unit 54 and the breathing mask 20 form an assembly 73. In particular, the assembly 73 provides a breathing gas to a user. The storage unit 54 may for example be a storage box. In particular, the storage unit 54 comprises walls 70, including side walls and a bottom wall. The walls 70 form a housing 51. The storage unit 54 also includes an access opening 71 opposite the bottom wall. The breathing mask 20 can be introduced into the housing 51 through the access opening 71. Furthermore, a cavity 72 is formed on one of the walls 70. The cavity 72 is formed close to the access opening 71. Furthermore, a cooperation portion 74 of the housing located close to the cavity 72 cooperates with the retaining device 33 of the breathing mask to retain the breathing mask 20 in the stored position relative to the storage unit 54. Advantageously, the retaining device 33 comprises two studs and the cooperation portion 74 of the housing 51 comprises two hooks. The storage unit 54 also comprises a moving part 53. The moving part 53 is composed of two parts (doors) 53A, 53B each pivoting laterally between a closed position and an open position to open the storage unit 54, clear the access opening 71 and access the breathing mask 20. The moving part 53 constitutes the front face of the storage unit 54 that is accessible to the user. The moving part 53 closes off the access opening 71. The cavity can hold the gripping portion 60. Therefore the gripping element 60 is held in the cavity 72 when the breathing mask 20 is stored in the storage unit 51. Furthermore, the moving part includes a passage facing the gripping element 60. Consequently, the free edge 64 of the gripping element 62 can be seen when the moving part 53 closes off the access opening 71. In another embodiment, the moving part 53 may include a single flap. According to yet another example, the storage unit 54 has no moving parts.

We will now describe the method used to put the harness 24 into the folded position. Putting the harness 24 into the folded position makes it possible in particular to store the breathing mask 20 in the storage unit 54.

In a first step a), the pulling device 55 is pulled through the guide device 65. More precisely, the gripping portion 60 is pulled by gripping the gripping element 62 to allow it to pass from the first position to the second position. The deflated harness 24 thus moves from an initial extended position to a final folded position. At the end of this step a), the connecting portion 58 stops in contact with the guide device 65.

In a step b), the gripping portion 60 is brought back into the reception zone 27 of the rigid support 28 with the stop surface 63 stopped in contact with the retaining device 33. Step b) takes place after step a).

In a step c), the breathing mask 20 is inserted in the storage unit 54. Step b) preferably takes place after step a).

In a step d), the gripping portion is placed close to the access opening 71 and the retaining device 33 is brought in cooperation with the cooperation portion 74, such that the breathing mask is retained relative to the housing 51, such that the gripping portion 60 is held by the breathing mask 20, the housing 51 and the stop surface 63 that bears on the retaining device 33 and such that the free edge 64 is visible, when the breathing mask is in the stored position in the storage unit 54 and when the storage unit 54 is closed. According to one example embodiment, step d) takes place after step c). According to another example, steps c) and d) take place simultaneously.

We will now describe a second embodiment with reference to FIGS. 5 to 9. The elements presented below relate only to elements that are different from the first embodiment. As can be seen for example on FIG. 5, this embodiment is different from the first embodiment essentially due to two distinct characteristics, namely the harness and the pulling device 55.

Figure 5:
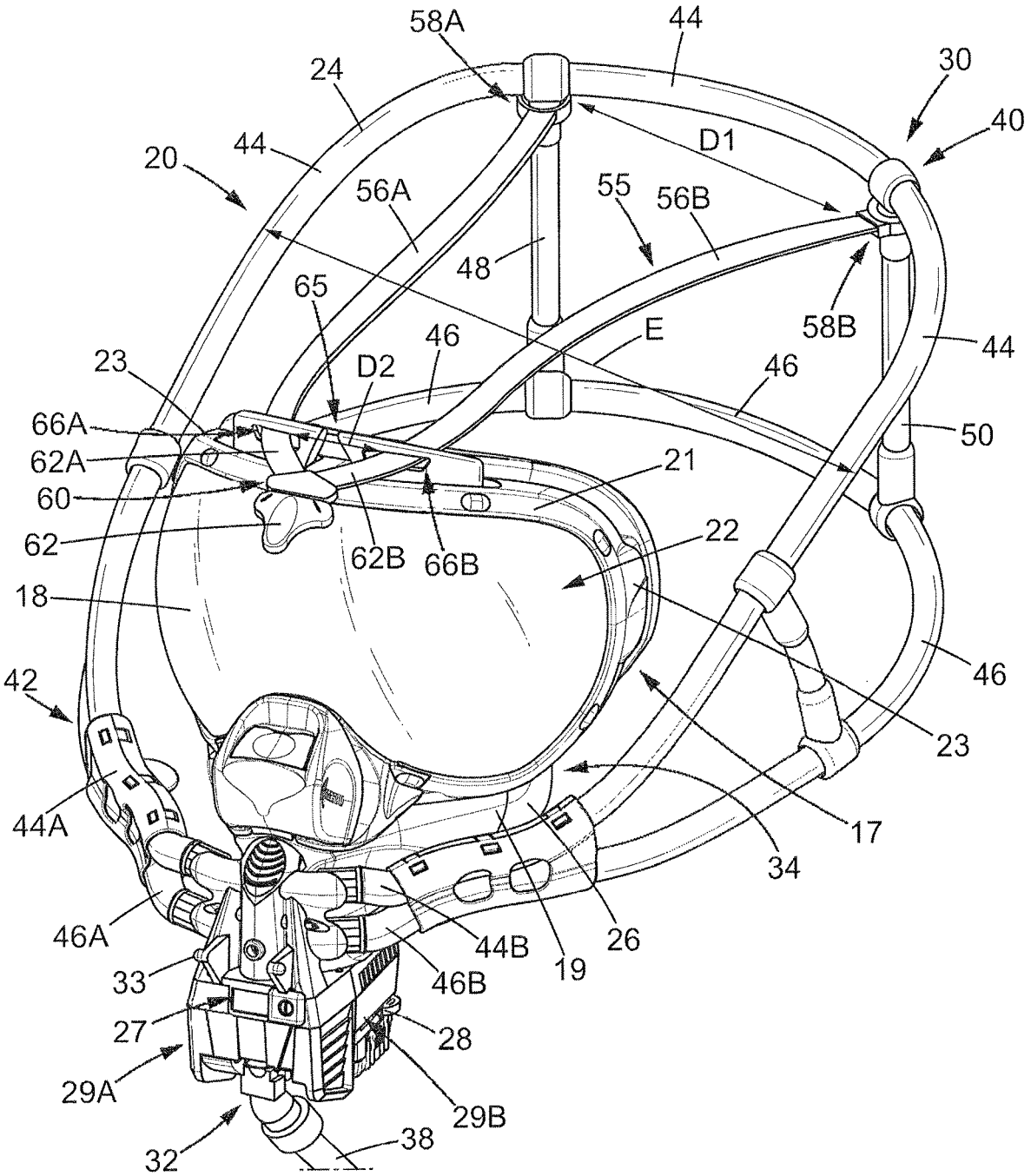
FIG. 5 is a perspective view of a breathing mask according to a second embodiment conforming with the invention, the harness being in the extended and inflated position.

As can be seen for example on FIG. 5, the harness 24 comprises two loops 44, 46: an upper loop 44 and a lower loop 46. The first ends 44A and 46A of the loops 44, 46 start at a first lateral part 29A of the rigid support 28. Similarly, the second ends 44B and 46B of the loops 44, 46 start at a second lateral part 29B of the rigid support 28. In particular, the two loops 44, 46 are connected together by spacer elements 48, 50, extending along a direction globally parallel to the vertical Z axis.

Furthermore, in this second example embodiment, the pulling device 55 comprises a first tie 56A and a second tie 56B, instead of a single tie as in the first embodiment illustrated in FIGS. 1 to 4. The first tie 56A comprises a first connecting portion 58A and a first gripping portion 62A, and the second tie 56B comprises a second connecting portion 58B and a second gripping portion 62B. The first connecting portion 58A and the second connecting portion 58B are arranged on the spacer elements 48 and 50 respectively. The first connecting portion 58A is located on the spacer element 48. The second connecting portion 58B is located on the spacer element 50. In another embodiment, it would also be possible that the first connecting portion 58A and the second connecting portion 58B could be laid out on the upper loop 44 of the harness 24.

Figure 9:
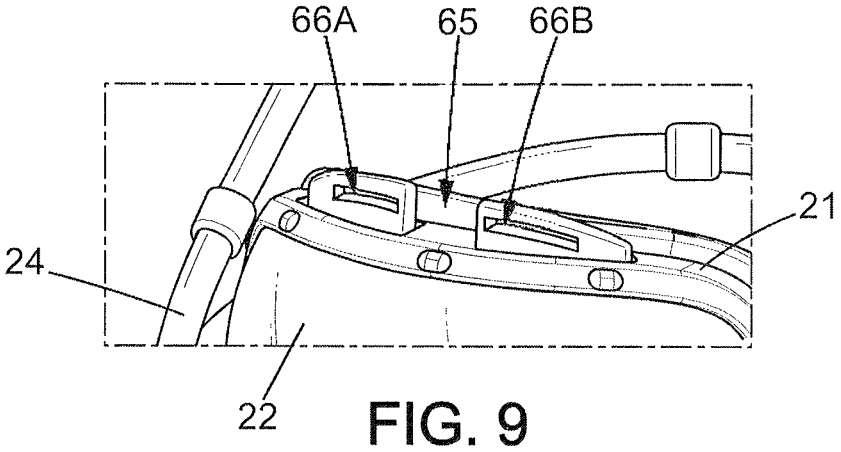
FIG. 9 is a partial perspective view of the second embodiment.

Furthermore, the guide device 65 comprises a first passage 66A and a second passage 66B, as can be seen on FIG. 9. The first tie 56A can pass through the first passage 66A. The second tie 56B can pass through the second passage 66B. The first passage 66A is separated from the first passage 66B by a distance D2. Each of the first passage 66A and the second passage 66B comprises an external lateral wall 67 and an internal lateral wall 68. As illustrated on FIG. 8, for each of the first passage 66A and the second passage 66B, the external lateral walls 67 are not parallel to the internal lateral walls 68. More precisely, the first passage 66A and the second passage 66B are tapered outwards from the first connecting portion 58A and the second connecting portion 58B respectively (in particular, the external lateral walls 67 are curved or comprise several straight segments) to facilitate sliding of the first tie 56A and the second tie 56B through the first passage 66A and the second passage 66B respectively. Furthermore, the external lateral walls 67 and the internal lateral walls 68 comprise first functional zones 67A, 68A and second functional zones 67B, 68B. The first functional zones 67A, 68A and the second functional zones 67B, 68B may be in contact with the first tie 56A and the second tie 56B. The functional zone 67A of the external lateral wall 67 is parallel to the functional zone 68 of the internal lateral wall 68. As the first tie 56A and the second tie 56B slide through the first passage 66A and the second passage 66B respectively, the first tie 56A and the second tie 56B are in contact with different functional zones. When the harness 24 is in the first position, the first tie 56A and the second tie 56B are in contact with the first functional zones 67A and 68A. When the harness 24 is in the second position, the first tie 56A and the second tie 56B are in contact with the second functional zones 67A and 68A.

As illustrated in FIG. 5, when the harness 24 is in the extended position, and in particular when the harness 24 is inflated, the first connecting portion 58A is at a distance D1 from the second connecting portion 58B more than the distance D2 between the first passage 65A and the second passage 65B, by at least 3 centimetres, and preferably at least 5 centimetres.

The first gripping portion 62A and the second gripping portion 62B are very close to each other and are preferably connected together in a single gripping element 62. The gripping element 62, the connecting portion 58A and the connecting portion 58B form a isosceles triangle of which the gripping element forms the vertex.

When the pulling device 55 is in the first position and the harness 24 is in its extended deflated position, the length L1 between the guide device 65 and the first connecting portion 58A and the second connecting portion 58B is much more than the length L2 between the guide device 65 and the first gripping portion 62A and the second gripping portion 62B. The first gripping portion 62A and the second gripping portion 62B are practically in contact with the guide device 65. The first tie 56A and the second tie 56B are in contact with the internal lateral wall 68 of the first passage 66A and the second passage 66B respectively.

When the pulling device 55 is moved from the first position to the second position, the harness 24 is brought into the folded position 24, the length L1 between the guide device 65 and the first connecting portion 58A and the second connecting portion 58B is much less than the length L2 between the guide device 65 and the first gripping portion 62A and the second gripping portion 62B. The first connecting portion 58A and the second connecting portion 58B are practically in contact with the guide device 65. The first tie 56A and the second tie 56B are in contact with the external lateral wall 67 of the first passage 66A and the second passage 66B respectively. The first connecting portion 58A is then at a distance from the second connecting portion 58B approximately equal to the distance D2 between the first passage 66A and the second passage 66B. The overall dimension E of the harness 24 along the direction of the transverse Y axis is thus reduced which facilitates insertion of the breathing mask 20 into the storage unit 54.

It should be noted that the characteristics of the strap and the ties 66A and 66B of the second example embodiment described above are independent of each other. For example, it would be possible to combine a harness 24 according to the second example embodiment and a tie 56 according to the first example embodiment. In this case, the connecting portion 58 can comprise two connecting sub-portions. Each connecting sub-portion can thus be arranged on a spacer element 48, 58 or on the loop 44, respectively. The tie 56A can pass through the passage 66A.

The invention claimed is:

1. Breathing mask for aircraft designed to provide a breathing gas to a user comprising a shell and an inflatable harness, the shell having a breathing cavity and being adapted to be applied onto the user's face around the user's mouth and nose, the harness being adapted to extend around the user's head opposite the shell so as to hold the shell on the user's face, wherein:

the breathing mask also comprises a folding system adapted to make the harness move from an extended position to a folded position, the folding system also comprises a pulling device and a guide device, the pulling device has a connecting portion connected to the harness and a gripping portion, the guide device is connected to the shell, the pulling device is free to move between:

a first position in which the pulling device allows the harness to be in the extended position, and a second position in which the pulling device holds the harness in the folded position, and the guide device cooperates with the pulling device to guide the pulling device between the extended position and the folded position.

2. Breathing mask according to claim 1, wherein:

the breathing mask also comprises a protection screen adapted to protect the user's eyes, and the guide device is fixed to the shell above the protection screen, along a vertical axis.

3. Breathing mask according to claim 2 wherein, when the harness is in the extended position, the gripping portion is located above the protection screen.

4. Breathing mask according to claim 1, wherein the pulling device is installed free to move in translation relative to the guide device, between the first position and the second position.

5. Breathing mask according to claim 1, wherein:

the pulling device comprises a first connecting portion connected to the harness and a second connecting portion connected to the harness, when the pulling device is in the first position the first connecting portion is at a distance from the second connecting portion by a first distance, the guide device comprises a first guide element and a second guide element, the first guide element is separated from the second guide element by a second distance, and the first distance is more than the second distance by at least 3 centimetres.

6. Breathing mask according to claim 1, wherein the pulling device comprises a band of elastically flexible material.

7. Breathing mask according to claim 1, wherein the harness extends in size under the effect of introducing gas under pressure inside the harness.

8. Assembly comprising a breathing mask and a storage unit inside which the breathing mask will fit, the breathing mask being a breathing mask for aircraft designed to provide a breathing gas to a user comprising a shell and an inflatable harness, the shell having a breathing cavity and being adapted to be applied onto the user's face around the user's mouth and nose, the harness being adapted to extend around the user's head opposite the shell so as to hold the shell on the user's face, the breathing mask also comprising a folding system adapted to make the harness move from an extended position to a folded position, the folding system also comprising a pulling device and a guide device, the pulling device having a connecting portion connected to the harness and a gripping portion, the guide device being connected to the shell, the pulling device being free to move between a first position in which the pulling device allows the harness to be in the extended position, and a second position in which the pulling device holds the harness in the folded position, and the guide device cooperating with the pulling device to guide the pulling device between the extended position and the folded position, the storage unit comprising a housing and an access opening through which the breathing mask is inserted into the housing, wherein in a stored position of the assembly in which the breathing mask is in the folded position, the gripping portion is located close to the access opening.

9. Assembly according to claim 8, wherein:

the breathing mask comprises a rigid support to which the shell is attached and with a reception zone, and the gripping portion is held in place between the housing and the reception zone of the rigid support when the assembly is in the stored position.

10. Method of folding a breathing mask to store it in a storage unit, the method comprising: providing a breathing mask, said breathing mask comprising: a shell, an inflatable harness, a folding system, the shell having a breathing cavity and being adapted to be applied onto the face of a user, the folding system comprising a pulling device and a guide device cooperating with the pulling device, the pulling device comprising a gripping portion, wherein in a step a) the pulling device is pulled through the guide device by gripping the gripping portion to pull the breathing mask from an initial extended position to a final folded position.

11. Method of folding according to claim 10, wherein the breathing mask also comprises a rigid support, the pulling device comprises a tie, the tie has a connecting portion and a gripping portion, the connecting portion being fixed onto the harness, and in a step b) subsequent to step a), the gripping portion is brought back to the rigid support, in a step c), the breathing mask is inserted in the storage unit, in a step d), the connecting portion is placed close to the access opening.

12. Method of folding according to claim 11 wherein step c) is done after step b).

13. Method of folding according to claim 11, wherein in step d), the gripping portion is placed close to the access opening and a retaining device is brought to cooperate with a cooperation portion.

14. Method of folding according to claim 11, wherein steps c) and d) are performed simultaneously.

15. Method of folding according to claim 11, wherein step d) is done after step c).

* * * * *